United States Patent [19]

Raman et al.

[11] Patent Number: 4,784,302

[45] Date of Patent: Nov. 15, 1988

[54] GAS ATOMIZATION MELT TUBE ASSEMBLY

[75] Inventors: Ramaswamy V. Raman, Framingham; Howard E. Surette, Lunenberg, both of Mass.

[73] Assignee: GTE Laboratories Incorporated, Waltham, Mass.

[21] Appl. No.: 947,149

[22] Filed: Dec. 29, 1986

[51] Int. Cl.[4] ..... B22F 9/08

[52] U.S. Cl. ..... 222/603; 222/606; 425/7; 264/12

[58] Field of Search ..... 222/591, 600, 606, 602, 222/603, 236; 425/7; 264/12; 75/0.5 C; 164/337, 437

[56] References Cited

U.S. PATENT DOCUMENTS

| | | | |
|---|---|---|---|
| 1,635,653 | 7/1927 | Williams . | |
| 2,997,245 | 8/1961 | Nilsson et al. | 241/1 |
| 3,253,783 | 5/1966 | Probst et al. | 239/82 |
| 3,341,092 | 9/1967 | Finn | 222/591 X |
| 3,344,469 | 10/1967 | Bylund et al. | 18/2.5 |
| 3,392,888 | 7/1968 | Cahoon, Jr. et al. | 222/591 X |
| 3,430,289 | 3/1969 | Aikawa et al. | 18/2.5 |
| 3,501,802 | 3/1970 | Ullman et al. | 18/2.5 |
| 3,533,136 | 10/1970 | Holtz, Jr. | 18/2.5 |
| 3,628,706 | 12/1971 | Todd | 222/591 |
| 3,639,548 | 2/1972 | Ullman et al. | 264/12 |
| 3,695,795 | 10/1972 | Jossick | 425/7 |
| 3,752,611 | 8/1973 | Reed et al. | 425/7 |
| 3,817,503 | 6/1974 | Lafferty et al. | 266/34 R |
| 3,841,539 | 10/1974 | Shapland, Jr. et al. | 222/600 X |
| 3,901,492 | 8/1975 | Lafferty | 266/34 R |
| 3,988,084 | 10/1976 | Esposito et al. | 425/7 |
| 4,080,126 | 3/1978 | Clark et al. | 425/7 |
| 4,131,219 | 12/1978 | Hind et al. | 222/600 X |
| 4,272,463 | 6/1981 | Clark et al. | 264/12 |
| 4,309,159 | 1/1982 | Holic | 425/7 |
| 4,374,633 | 2/1983 | Hart | 425/7 |
| 4,382,903 | 5/1983 | Larsson et al. | 264/12 |
| 4,385,878 | 5/1983 | Larsson et al. | 425/7 |
| 4,386,896 | 6/1983 | Ray | 425/7 |
| 4,416,600 | 11/1983 | Leczner et al. | 425/7 |
| 4,439,379 | 3/1984 | Hart | 264/12 |
| 4,573,616 | 3/1986 | Shapland | 222/591 X |
| 4,575,325 | 3/1986 | Duerig et al. | 425/7 |
| 4,619,597 | 10/1986 | Miller | 425/7 |
| 4,619,845 | 10/1986 | Ayers et al. | 427/422 |
| 4,631,013 | 12/1986 | Miller | 425/7 |
| 4,632,170 | 12/1986 | Pöhl | 164/250.1 |
| 4,640,806 | 2/1987 | Duerig et al. | 264/9 |
| 4,646,968 | 3/1987 | Sablatura | 239/10 |
| 4,682,717 | 7/1987 | Marino et al. | 222/591 |
| 4,682,718 | 7/1987 | Watanabe et al. | 222/591 |

FOREIGN PATENT DOCUMENTS

| | | | |
|---|---|---|---|
| 2064123 | 3/1972 | France | 222/600 |
| 444603 | 6/1975 | U.S.S.R. | 222/591 |
| 0897401 | of 1982 | U.S.S.R. . | |
| 1026967 | of 1983 | U.S.S.R. . | |
| 2007129 | 5/1979 | United Kingdom . | |
| 2065850 | 7/1981 | United Kingdom | 222/600 |
| 2154902 | 9/1985 | United Kingdom . | |

OTHER PUBLICATIONS

Anderson et al., submitted to *Metallurgical Transactions*, Sep. 20, 1984 (unpublished).

Backmark et al., *Powder Metallurgy Intl.*, 18, 338–40 (1986).

*Primary Examiner*—Joseph J. Rolla
*Assistant Examiner*—Nils E. Pedersen
*Attorney, Agent, or Firm*—Frances P. Craig

[57] ABSTRACT

A melt tube assembly comprising a melt delivery tube and a supporting and insulating shield providing mechanical protection to the melt tube tip and a thermal barrier between the flowing melt and the gas atomization nozzle and the gas jets issuing therefrom during confined gas atomization. In a preferred embodiment, the melt tube tip is a separate element, easily replaceable or interchangeable without removing the melt delivery tube from the crucible.

20 Claims, 3 Drawing Sheets

GAS ATOMIZATION MELT TUBE ASSEMBLY

BACKGROUND OF THE INVENTION

This invention relates to apparatus for the production of fine powders from a liquid melt by gas atomization and solidification, and more particularly to a melt tube assembly for delivering a stream of high temperature melt to the atomization zone of such apparatus.

It is known to pass a stream of molten material, for example molten metal, through a nozzle or melt delivery tube, and to direct one or more high velocity fluid jets at the emerging stream to break up the stream into small globules, which are then solidified into particulates of varying sizes. Typical atomizing apparatus suitable for atomizing metals includes a heated crucible for melting or maintaining the melt temperature of the metal, a melt delivery tube for directing a stream of the melt to an atomizing zone below the crucible, and a gas nozzle to direct one or more streams or sheets of atomizing gas to impinge on the melt stream at the atomizing zone.

However, melt tube arrangements for atomizing molten metals for use in making powdered products have left much to be desired, particularly in the atomization of higher melting metals, i.e. those having melting points above 1000° C., and especially of alloys having melting temperatures above 1200° C. The major problems affecting known atomization apparatus and processes are: freeze-up (solidification of the melt) at the melt tube outlet, erosion of the melt tube, and melt tube breakage. In confined gas atomization systems, i.e. systems in which the gas nozzle closely surrounds the melt delivery tube, the outer surface of the tube is subject to severe cooling due to the proximity or actual impingement thereon of the atomizing gas, the temperature of which is greatly lowered by expansion as it exits the gas nozzle. In contrast, the inner surface of the tube is exposed to high temperature metal melts, some in excess of 1200°-1500° C. Thus, the melt delivery tube experiences severe thermal stress due to this drastic temperature differential between its inner and outer surfaces. Further, the inner surface of the melt delivery tube is subject to substantial erosive forces due to the flow of the melt aspirated therethrough, while the entire tube experiences severe mechanical shock or spring forces during the start-up of the high pressure gas flow.

The superimposition of these mechanical and thermal stresses generally leads to catastrophic failure of the system due to fracture of the melt delivery tube. The change in melt tube geometry and melt outlet position due to the fracture leads to backpressure conditions on the melt causing a cessation of melt flow and even the bubbling of atomization gas upward through the melt in the crucible. These problems have greatly increased the cost of operating such a confined system in a production environment where component reliability over an extended time is a necessity. This in turn has led to the underutilization of confined gas atomization in production processes and has led to increases in the cost of the metal powders produced thereby.

SUMMARY OF THE INVENTION

The melt tube assembly according to the present invention reduces or eliminates problems of catastrophic failure of the melt delivery tube by the provision of a structure which is mechanically stronger and provides thermal and mechanical insulation for the element(s) in contact with the high temperature melt, i.e. an insulating support shield surrounding the tip of the melt tube. The preferred assembly presents a further advantage, in that the melt tube tip is separate from the portion of the melt tube seated against or within the crucible, and may be easily and quickly removed and replaced. In a most preferred embodiment, the support shield encloses the joint between the melt tube and melt tube tip, and holds the tip in place against the melt tube.

The melt delivery tube assembly according to the present invention is intended for use with a melt reservoir having a downwardly opening outlet. The assembly includes a refractory melt delivery tube having a longitudinal bore therethrough. The tube has an upper portion, and a lower portion having a tip. The upper portion is seatable at the reservoir outlet for melt flow from the reservoir generally vertically downward through the reservoir outlet and melt tube bore. A thermally insulating support shield having a longitudinal bore therethrough is coaxially and removeably mounted surrounding the longitudinal outer surfaces of at least the lower portion of the melt tube. The support shield bore is shaped complementarily to the surrounded outer surfaces of the melt tube for close and slideable fit thereover.

A preferred melt delivery tube assembly according to the invention includes a refractory melt delivery tube having an upper portion, a lower portion, and a longitudinal bore therethrough. The upper portion of the tube is seatable at the reservoir outlet for melt flow from the reservoir generally vertically downward through the reservoir outlet and melt tube bore. A refractory melt tube tip has an upper portion, a lower portion and a longitudinal bore therethrough. The upper portion is coaxially and removeably positionable at the melt tube lower portion for melt flow from the melt tube bore through the melt tube tip bore. A supporting and thermally insulating shield having a longitudinal bore therethrough is coaxially and removeably mountable surrounding the longitudinal outer surfaces of the melt tube tip and at least the lower portion of the melt tube. The shield bore is shaped complementarily to the surrounded outer surfaces of the melt tube tip and the melt tube for close and slideable fit thereover. The support shield includes means for reversibly retaining the melt tube tip in position within the assembly. The support shield and melt tube tip are easily disassemblable from and reassemblable with each other and with the melt tube without removing the melt tube from the reservoir outlet.

In another preferred assembly, the melt tube has upper surfaces of a configuration for seating of the melt tube at the reservoir outlet, and a downwardly facing countered socket coaxial with the melt tube bore. The melt tube tip upper portion is coaxially and removeably positionable within the melt tube socket. The support shield bore is shaped complementarily to the portion of the melt tube tip which protrudes from the socket for close and slideable fit thereover.

In yet another preferred assembly, the tip bore provides a metering orifice for the melt flow through the assembly. Thus, the melt tube tip may be one of a set of interchangeable tips of differing metering orifice diameters, so that the tip may be selected to provide the desired metering orifice diameter.

BRIEF DESCRIPTION OF THE DRAWINGS

For a better understanding of the present invention, together with other and further advantages, objects, and capabilities thereof, reference is made to the following disclosure and appended claims together with the drawings, in which.

DETAILED DESCRIPTION OF THE PREFERRED EMBODIMENTS

Figure 1:
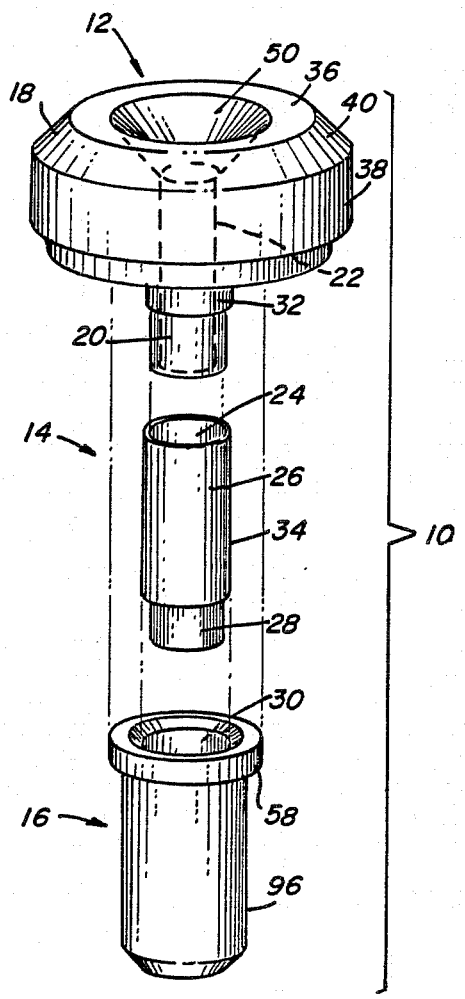
FIG. 1 is an exploded perspective view of one embodiment of the melt tube assembly according to the invention.

An illustrative melt tube assembly 10 according to the invention, as shown in FIG. 1, includes three parts: melt delivery tube 12, melt tube tip 14, and thermally insulating support shield 16. Melt tube 12 includes upper portion 18, lower portion 20, and bore 22 passing longitudinally through melt tube 12. Melt tube tip 14 includes bore 24 passing longitudinally through the tip. Melt tube tip 14 also includes upper portion 26 and lower portion 28. Alternatively, tip 14 may be unitary with melt tube 12. Support shield 16 includes bore 30 passing therethrough. The diameter of bore 30 is selected to provide close sliding fit of support shield 16 over outer surface 32 of melt tube lower portion 20 and outer surface 34 of tip 14. Upper portion 18 includes annular top surface 36, annular cylindrical surface 38, and annular beveled surface 40 interconnecting surfaces 36 and 38. The melt tube and melt tube tip are formed of refractory materials compatable with the molten metal to be atomized. A preferred material for the melt tube and tip is graphite. The support shield is formed of a material having sufficient mechanical and thermal stress and shock resistance to withstand the atomizing process, and should be inert to the molten metal. Suitable materials include high temperature molybdenum, titanium, or niobium based alloys, carbon-carbon composites, or advanced ceramics such as $Si_3N_4$, boron nitride, or $Al_2O_3$ monolithic or composite materials.

Figure 2:
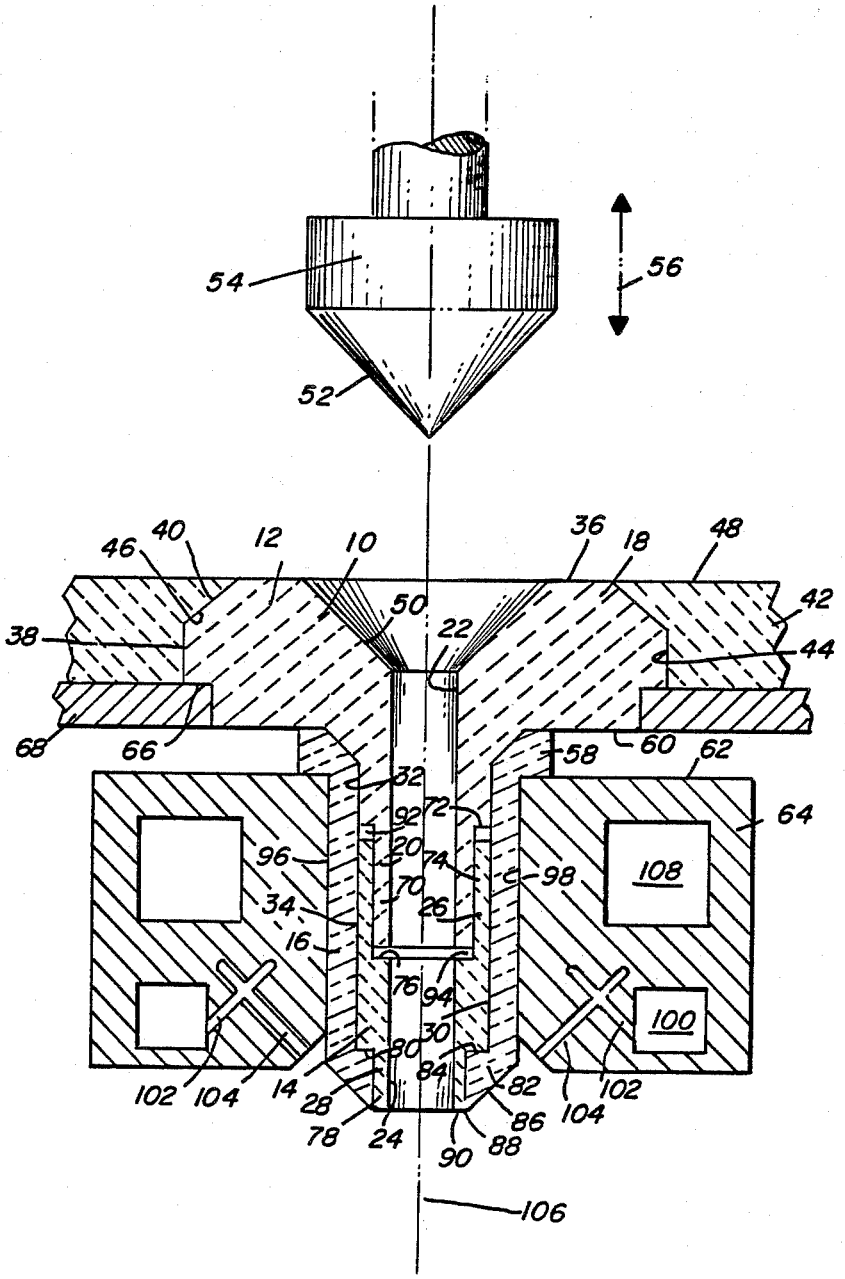
FIG. 2 is a sectional elevation view, schematically representing a portion of a typical gas atomization apparatus including the melt nozzle assembly according to the invention.

FIG. 2 illustrates a portion of a typical gas atomization system including melt tube assembly 10. Melt crucible 42 includes bore 44 of a diameter selected for close fit of melt tube cylindrical surface 38 therein. Bore 44 includes annular beveled shoulder 46 to act as a stop for melt tube 12 within bore 44. Shoulder 46 is shaped complementarily to beveled surface 40 of melt tube 12 for sealing of beveled surface 40 against beveled shoulder 46. The seal between surface 40 and shoulder 46 is maintained by the close fit between surfaces 38 and 44. Normally, refractory cement is also used to ensure that melt tube 12 remains fixed in sealing relationship with melt crucible 42. Preferably upper surface 36 of melt tube 12 is contiguous with inner surface 48 of crucible 42. Melt tube bore 22 may include conical portion 50, shaped complimentarily to conical portion 52 of stopper rod 54 to provide a melt flow valve. Stopper rod 54 may be moved in known manner vertically upward or downward as shown by arrow 56, to seat conical portion 52 within conical portion 50 to prevent flow of melt through bore 22, or to raise the conical portion to permit melt flow. A closing force is maintained on stopper rod 54 prior to atomization.

As shown in the embodiment illustrated in FIG. 2, annular flange 58 of support shield 16, bears against lower annular surface 60 of melt tube upper portion 18. Flange 58 is supported by upper surface 62 of annular gas atomization nozzle 64. Melt tube 12 is supported independently of shield 16, as described above, so that the shield may be removed without unseating melt tube upper portion 18 from its position within bore 44 of crucible 42. Such independent support may also be augmented in known manner, for example by resting annular shoulder 66 of tube upper portion 18, and optionally crucible 42 on support means 68, as shown in FIG. 2. Shield 16 may then be supported as shown in FIG. 2 or, for example, by releaseably securing shield 16 to tube 12 in known manner.

Lower portion 20 of melt tube 12 includes cylindrical stem 70 of smaller diameter than outer surface 32 of lower portion 20, forming shoulder 72 joining stem 70 and outer surface 32. Similarly, upper portion 26 of melt tube tip 14 includes counterbored socket 74, the inside diameter of which is larger than the diameter of bore 24 passing through tip 14, socket 74 forming with bore 24 upper shoulder 76. The inner diameter of socket 74 and the outer diameter of stem 70 are selected for close slideable fit of melt tube 12 and tip 14.

The diameters of bores 22 and 24 may be the same or different. In the preferred melt tube assembly, at least a portion of bore 24 is of a diameter equal to or smaller than that of bore 22, providing a metering orifice for control of the melt mass flow rate. Outer surface 34 of melt tube tip 14 may be the same or smaller diameter than outer surface 32 of tube lower portion 20. Bore 30 of shield 16 is of a configuration selected for close sliding fit over outer surfaces 34 and 32 of melt tube tip 14 and melt delivery tube 12 respectively. Melt tube 12 as shown in FIG. 2 includes an annular 45° fillet at the intersection of outer surface 32 and lower surface 60, providing a structural reinforcing support against shear stresses encountered during atomization. Shield bore 30 is shaped complementarily to all enclosed surfaces of melt tube 12 and tip 14, providing further structural support to the assembly, particularly at the joint between melt tube 12 and tip 14, where stem 70 and socket 74 are each of reduced thickness and structural strength. Preferably, lower portion 28 of melt tube tip 14 includes stem 78 of smaller outer diameter than that of outside surface 34 of melt tube tip 14, forming with outside surface 34 lower shoulder 80. Shield bore 30 is shaped complementarily to lower portion 28, stem 78, and shoulder 80 of melt tube tip 14, so that shoulder 80 of tip 14 rests on and is supported by shoulder 84 of shield bore 30 and stem 78 fits closely within shield lower portion 82. Thus, tip 14 is retained in place within the assembly by shield 16. The thermal barrier provided by support shield 16 is enhanced by the small insulating air space provided by the slideable fit of the shield over the melt tube and tip.

Shield 16 as shown in FIG. 2 includes beveled surface 86 providing annular sharp edge 88 at the bottom of shield 16. Alternatively, shield lower portion 82 may be provided with an annular, planar lower surface or a combination of an outer beveled surface and an inner planar surface. Preferably, sharp edge 88 (or the corresponding planar surface) and bottom surface 90 of melt tube tip 14 are coplanar, so that all longitudinal surfaces of tip 14 are entirely covered by support shield 16. The longitudinal dimensions of melt delivery tube 12, melt tube tip 14 and shield 16 preferably are selected to provide gaps 92 and 94 between tip 14 and melt tube lower portion 20, allowing for thermal expansion of the tip in use. Outer surface 96 of shield 16 is conveniently of a diameter permitting close slideable fit within central bore 98 of gas atomization nozzle 64.

Gas nozzle 64 further includes annular gas plenum 100, and an annular array of bores 102 and 104 to deliver pressurized atomizing gas to atomizing zone 106. Preferably, bores 104 are inclined at the same angle from the vertical as beveled surface 86 of shield 16, so that high pressure gas jets flowing from bores 104 toward atomization zone 106 trace a conical configuration complementary to beveled surface 86. The close fit of support shield 16 within bore 98 of nozzle 64 provides precise centering of the melt flow to coincide with the apex of the cone traced by the gas jets. Most preferably some of the gas impinges on beveled surface 86 and is deflected downward to create aspiration conditions, as described in commonly assigned, copending U.S. patent application Ser. No. 926,482. Alternatively, where shield lower portion 82 has no beveled surface, as described above, all of the atomizing gas may impinge outer surface 96 of shield 16, resulting in different atomizing conditions than those described in application No. 926,482. Optionally, annular heat transfer chamber 108 may be provided for flow through gas nozzle 64 of a heat transfer fluid, for example a cooling gas.

Prior to operation of the atomization system, elements 12, 14 and 16 of melt tube assembly 10, as shown in FIGS. 1 and 2, are assembled. Melt tube upper portion 18 is inserted into crucible bore 44 and secured as described above. Melt tube assembly 10 then may be quickly and easily assembled by sliding melt tube tip 14 into shield bore 30 so that tip stem 78 fits within shield lower portion 82 and tip lower shoulder 80 rests upon shield shoulder 84. Shield 16 is then slid into place surrounding outer surface 32 of melt tube 12 so that elements 12, 14 and 16 are arranged in close sliding relationship as shown in FIG. 2.

Crucible 42 is lowered into position, fitting gas nozzle bore 98 around outside surface 96 of support shield 16. Stopper rod 54 is seated in the closed position with conical surface 52 resting within conical surface 50 of melt delivery tube 12, during the filling of the crucible and, if necessary, the melting of the material to be atomized.

At the start of the atomization process, stopper rod 54 is vertically raised out of its seated position to initiate melt flow through bores 22 and 24 of melt tube 12 and melt tube tip 14 respectively, toward atomization zone 106. Pressurized atomizing gas flows from a source (not shown) into annular gas plenum 100 of gas nozzle 64, flowing through bores 102 and 104 to exit nozzle 64 as an array of gas streams, preferably sweeping shield conical surface 86, and impinging the stream of molten material flowing from tip bore 24 at atomization zone 106. The impinging gas streams break the melt stream into small globules of melt, which are rapidly solidified into fine particles to form a powder of the atomized material.

Gas nozzle 64 is cooled by a cooling gas flowing from a source (not shown) through annular heat transfer chamber 108. However, melt delivery tube 12 and melt tube tip 14 are not in direct contact with the cooled surfaces 62 and 98 of gas nozzle 64, but are insulated therefrom by support shield 16. Thus melt tube 12 and melt tube tip 14 are protected from the cracking due to thermal shock caused by the drastic temperature differential which would otherwise occur between the inner surfaces in contact with the hot melt flowing through bores 22 and 24 and outer surfaces 32 and 34.

Further, the high pressure gas flowing through gas nozzle 64 is chilled by expansion as it exits bores 104. The impingement of this chilled gas against tip lower portion 28 could cause severe differential expansion resulting in cracking or shattering and catastrophic failure of the tip lower portion. However, support shield 16 covers and protects tip lower portion 28 from direct impingement of the chilled gas.

Support shield 16 also presents a further advantage, in that melt tube tip 14 and the melt flowing therethrough are not instantaneously cooled by the impinging chilled gas because of the thermal barrier presented by the shield and by the insulating air gap between shield 16 and tip 14. Thus, premature solidification of melt within bore 24 due to such conductive cooling is minimized. Also, if minor cracking of melt tube tip 14 should occur, the tip is protected from shattering by the support provided by the walls of bore 30 closely surrounding tip 14. Further, in the event of cracking of tip 14, catastrophic failure of the system due to melt "splash-up" is prevented. In prior art systems, changes in the geometry of the melt tube tip resulted in development of severe backpressure, causing the melt to splatter upward and damage the components of the system. With the shield in place, the geometry of the melt tube assembly is unchanged by such tip failure.

An even further advantage is provided by the embodiment of the melt tube assembly illustrated in FIGS. 1 and 2, in that in the event of severe damage to melt tube tip 14, the tip may be quickly and easily removed and replaced without the removal of the melt tube from the crucible. For example, in the event of catastrophic failure of tip 14, stopper rod 54 is lowered into the closed position to stop the flow of melt through melt tube assembly 10. Crucible 42 is then raised away from gas atomization nozzle 64 carrying with it melt tube 12, shield 16 and melt tube tip 14. When support shield 16 is sufficiently clear of nozzle 64, the shield is removed from melt tube 12, shattered tip 14 is removed from the shield, and a new tip 14 is inserted therein. The system is then rapidly reassembled by fitting shield 16 and tip 14 around lower portion 20 of melt tube 12 and lowering crucible 42 into position. The flows of melt and high pressure gas may then be resumed to start up operation.

The above-described procedure may also be used to provide another unique advantage of the melt tube assembly of the present invention. A series of melt tube tips 14 having identical upper and outer configurations may be provided. However, metering orifices of different diameters may be provided by bore 24 of each tip and/or different materials or coatings may be used for each tip. Thus, the melt tube assembly of the present invention may be adapted to the atomization of different materials, or the flow rate of a single molten material may be adjusted to control the size of the particles produced, as described in above-referenced application No. 926,482.

Figure 3:
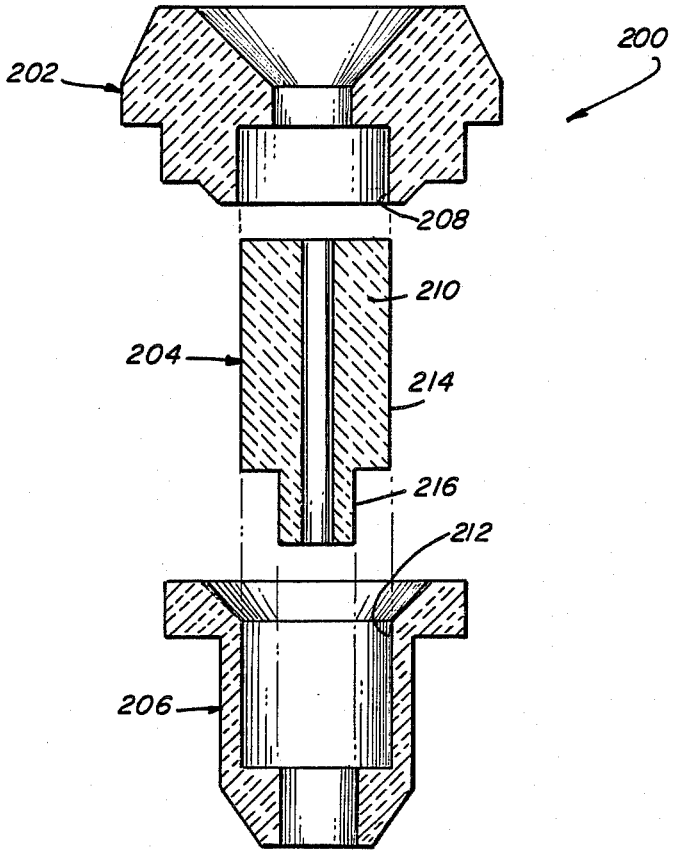
FIG. 3 is an exploded sectional elevation view, schematically representing another embodiment of the melt tube assembly according to the invention.

An alternate embodiment of the melt tube assembly according to the invention is shown in FIG. 3. Melt tube assembly 200 includes melt tube 202, melt tube tip 204 and insulating support shield 206. All features of assembly 200 are similar to those described above for assembly 10, except the manner in which the melt tube and melt tube tip are mated for operation. Melt tube 202 includes socket 208 (replacing lower portion 20 of melt tube 12). Melt tube tip 204 includes upper portion 210. The diameters of socket 208 and tip upper portion 210 are selected for close slideable fit of tip upper portion 210 within socket 208 during pre-operation assembly. The diameter of shield bore 212 is selected for close slideable fit over tip outer surface 214 and tip stem 216, in the same manner described above for shield 16. This arrangement of elements further reduces the stress placed on melt tube 12, particularly that imposed on lower portion 20 and stem 70 of melt tube 12, and increases the surface area of contact between the melt tube and melt tube tip.

While there has been shown and described what are at present considered the preferred embodiments of the invention, it will be obvious to those skilled in the art that various changes and modifications can be made therein without departing from the scope of the invention as defined by the appended claims.

We claim:

1. In a confined gas atomization apparatus for producing fine metal powder from a high temperature melt, and having a melt reservoir having a downwardly opening outlet, an annular gas nozzle to deliver high pressure gas to an atomizing zone below the melt reservoir, the gas nozzle having a longitudinal bore therethrough, and a melt delivery tube projecting from the reservoir outlet, through the gas nozzle bore to near the atomizing zone, the improvement wherein the melt delivery tube comprises a melt delivery tube assembly comprising:

a refractory melt delivery tube having a longitudinal bore therethrough and comprising an upper portion seatable at the reservoir outlet for melt flow from the reservoir generally vertically downward through the reservoir outlet and melt tube bore, and a lower portion having a tip; and a supporting and thermally insulating shield having a longitudinal bore therethrough and coaxially and removeably mounted surrounding the longitudinal outer surface of at least the lower portion of the melt tube, including the entire tip, to provide a thermal barrier against impinging atomizing gas, wherein the support shield bore is shaped complementarily to the surrounded outer surfaces of the melt tube for close and slideable fit thereover, and the outer surface of the support shield is of a diameter permitting close and slideable fit of the support shield within the annular gas nozzle bore.

2. An assembly according to claim 1 wherein the melt tube tip bore provides a metering orifice for the melt flow through the assembly.

3. An assembly according to claim 1 wherein the tube is reversibly retainable in position at the reservoir outlet.

4. In a confined gas atomization apparatus for producing fine metal powder from a high temperature melt, and having a melt reservoir having a downwardly opening outlet, an annular gas nozzle to deliver high pressure gas to an atomizing zone below the melt reservoir, the gas nozzle having a longitudinal bore therethrough, and a melt delivery tube projecting from the reservoir outlet, through the gas nozzle bore to near the atomizing zone, the improvement wherein the melt delivery tube comprises a melt delivery tube assembly comprising:

a refractory melt delivery tube having a longitudinal bore therethrough and comprising an upper portion seatable at the reservoir outlet for melt flow from the reservoir generally vertically downward through the reservoir outlet and melt tube bore, and a lower portion;

a refractory melt tube tip not unitary with the melt tube, having a longitudinal bore therethrough, and comprising an upper portion coaxially and removeably positionable at the melt tube lower portion for melt flow from the melt tube bore through the melt tube tip bore, and a lower portion; and a supporting and thermally insulating shield having a longitudinal bore therethrough and coaxially and removeably mountable surrounding the longitudinal outer surfaces of the entire melt tube tip and at least the lower portion of the melt tube to provide a thermal barrier against impinging atomizing gas, wherein the shield bore is shaped complementarily to the surrounded outer surfaces for close and slideable fit thereover, and the outer surface of the support shield is of a diameter permitting close and slideable fit of the support shield within the annular gas nozzle bore, the support shield includes means for removably retaining the melt tube tip in position within the assembly and means adapted for support of the shield by the annular gas nozzle, and the support shield and melt tube tip are easily disassemblable from and reassemblable with each other and with the melt tube without removing the melt tube from the reservoir outlet by lowering or raising the annular gas nozzle relative to the reservoir.

5. An assembly according to claim 4 wherein the melt tube tip bore provides a metering orifice for the melt flow through the assembly.

6. An assembly according to claim 4 wherein the melt tube lower portion includes a stem and the melt tube tip upper portion includes a countered socket, the stem and the socket being slideably couplable within the support shield.

7. An assembly according to claim 6 wherein the dimensions of the melt tube, the melt tube tip, and the shield are selected to permit surrounding of at least the melt tube lower portion by the shield, and thermal expansion of at least one of the melt tube lower portion and the melt tube tip within the shield.

8. An assembly according to claim 4 wherein the tube is reversibly retainable in position at the reservoir outlet.

9. An assembly according to claim 4 wherein the upper portion of the melt tube is shaped to accept complementary stopper means to prevent melt flow through the assembly.

10. An assembly according to claim 4, wherein the means adapted for support of the shield by the annular gas nozzle comprises an annular flange on the shield adapted to rest on the annular gas nozzle to removeably mount the shield in position in the assembly

11. An assembly according to claim 4 wherein at least one of the melt tube and the melt tube tip is formed of graphite.

12. An assembly according to claim 4 wherein the support shield is formed from a material selected from the group consisting of molybdenum- titanium- and niobium-bases alloys, carbon-carbon composites, and alumina-, silicon nitride-, and boron nitride-based monolithic and composite tough and thermal shock resistant ceramics.

13. In a confined gas atomization apparatus for producing fine metal powder from a high temperature melt, and having a melt reservoir having a downwardly opening outlet, an annular gas nozzle to deliver high pressure gas to an atomizing zone below the melt reservoir, the gas nozzle having a longitudinal bore therethrough, and a melt delivery tube projecting from the reservoir outlet, through the gas nozzle bore to near the atomizing zone, the improvement wherein the melt delivery tube comprises a melt delivery tube assembly comprising:

a refractory melt delivery tube having a longitudinal bore therethrough and comprising an upper portion seatable at the reservoir outlet for melt flow from the reservoir generally vertically downward through the reservoir outlet and melt tube bore, and a lower portion;

a refractory melt tube tip not unitary with the melt tube, having a longitudinal bore therethrough, and comprising an upper portion coaxially and removeably positionable at the melt tube lower portion for melt flow from the melt tube bore through the melt tube tip bore, and a lower portion; and a supporting and thermally insulating shield having a longitudinal bore therethrough and coaxially and removeably mountable surrounding the longitudinal outer surfaces of the entire melt tube tip and at least the lower portion of the melt tube to provide a thermal barrier against impinging atomizing gas, wherein the shield bore is shaped complementarily to the surrounded outer surfaces for close and slideable fit thereover, and the outer surface of the support shield is of a diameter permitting close and slideable fit of the support shield within the annular gas nozzle bore, the support shield includes means for removably retaining the melt tube tip in position within the assembly and means adapted for support of the shield by the annular gas nozzle, and the support shield and melt tube tip are easily disassemblable from and reassemblable with each other and with the melt tube without removing the melt tube from the reservoir outlet by lowering or raising the annular gas nozzle relative to the reservoir;

wherein the melt tube bore provides a metering orifice for the melt flow through the assembly; and the melt tube tip comprises one of a plurality of interchangeable tips of differing metering orifice diameters, the one tip being selected to provide the desired metering orifice diameter.

14. In a confined gas atomization apparatus for producing fine metal powder from a high temperature melt, and having a melt reservoir having a downwardly opening outlet, an annular gas nozzle to deliver high pressure gas to an atomizing zone below the melt reservoir, the gas nozzle having a longitudinal bore therethrough, and a melt delivery tube projecting from the reservoir outlet, through the gas nozzle bore to near the atomizing zone, the improvement wherein the melt delivery tube comprises a melt delivery tube assembly comprising:

a refractory melt delivery tube having a longitudinal bore therethrough, upper surfaces of a configuration for seating of the melt tube at the reservoir outlet for melt flow from the reservoir generally vertically downward through the reservoir outlet and melt tube bore, and a downwardly facing countered socket coaxial with the melt tube bore;

a refractory melt tube tip not unitary with the melt tube, having a longitudinal bore therethrough, and comprising an upper portion coaxially and removeably positionable within the melt tube socket for melt flow from the melt tube bore through the melt tube tip bore, and a lower portion; and a supporting and thermally insulating shield having a longitudinal bore therethrough and coaxially and removeably mountable surrounding the longitudinal outer surfaces of the entire melt tube tip and at least the lower portion of the melt tube containing the socket to provide a thermal barrier against impinging atomizing gas, wherein the shield bore is shaped complementarily to the surrounded outer surfaces for close and slideable fit thereover, and the outer surface of the support shield is of a diameter permitting close and slideable fit of the support shield within the annular gas nozzle bore, the support shield includes means for removeably retaining the melt tube tip in position within the assembly and means adapted for support of the shield by the annular gas nozzle, and the support shield and melt tube tip are easily disassemblable from and reassemblable with each other and with the melt tube without removing the melt tube from the reservoir outlet by lowering or raising the annular gas nozzle relative to the reservoir.

15. An assembly according to claim 14 wherein the melt tube tip bore provides a metering orifice for the melt flow through the assembly.

16. An assembly according to claim 15 wherein the melt tube tip comprises one of a plurality of interchangeable tips of differing metering orifice diameters, the one tip being selected to provide the desired metering orifice diameter.

17. An assembly according to claim 14 wherein the upper portion of the melt tube is shaped to accept complementary stopper means to prevent melt flow through the assembly.

18. An assembly according to claim 14 wherein the means adapted for support of the shield by the annular gas nozzle comprises an annular flange of the shield adapted to rest on the annular gas nozzle to removeably mount the insulating shield in position in the assembly.

19. An assembly according to claim 14 wherein at least one of the melt tube and the melt tube tip is formed of graphite.

20. An assembly according to claim 14 wherein the support shield is formed from a material selected from the group consisting of molybdenum-, titanium-, and niobium-based alloys, carbon-carbon composites, and alumina-, silicon nitride-, and boron nitride-based monolithic and composite tough and thermal shock resistant ceramics.

* * * * *